United States Patent [19]

Cargnino et al.

[11] Patent Number: 4,552,678

[45] Date of Patent: Nov. 12, 1985

[54] CORROSION INHIBITORS FOR AQUEOUS LIQUIDS FOR THE WORKING OF METALS, AND A PROCESS FOR THEIR PREPARATION

[76] Inventors: Francesco Cargnino; Giuseppe Natoli; Horst Lorke, all of Hoechst Aktiengesellschaft, P.O. Box 80 03 20, D-6230 Frankfurt am Main 80, Fed. Rep. of Germany

[21] Appl. No.: 544,362

[22] Filed: Oct. 21, 1983

[30] Foreign Application Priority Data

Oct. 25, 1982 [IT] Italy ..... 23902 A/82

[51] Int. Cl.[4] ..... C10M 3/30

[52] U.S. Cl. ..... 252/49.3; 252/394; 260/501.15; 564/155; 564/158; 564/159

[58] Field of Search ..... 252/49.3, 394; 260/501.15; 564/155, 158, 159

[56] References Cited

U.S. PATENT DOCUMENTS

| | | | |
|---|---|---|---|
| 4,168,292 | 9/1979 | Redmore et al. | 422/12 |
| 4,273,664 | 6/1981 | Brandolese | 252/49.3 |
| 4,374,741 | 2/1983 | Rieder | 252/49.3 |

*Primary Examiner*—William R. Dixon, Jr.
*Assistant Examiner*—Margaret B. Medley

[57] ABSTRACT

The invention relates to novel compounds which are particularly suitable as corrosion inhibitors for aqueous liquids for the cleaning of metals, and especially as corrosion inhibitors for oil-free aqueous liquids used for the working of metals, in particular those exposed to corrosion. The compounds according to the invention correspond to the formula

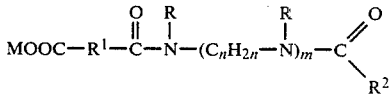

(I)

The invention also relates to a process for their preparation.

5 Claims, No Drawings

CORROSION INHIBITORS FOR AQUEOUS LIQUIDS FOR THE WORKING OF METALS, AND A PROCESS FOR THEIR PREPARATION

The invention relates to corrosion inhibitors which are particularly suitable for use as corrosion inhibitors for the working of metals.

The present invention moreover relates to a process for the preparation of these corrosion inhibitors. Finally, the present invention relates to aqueous, oil-free liquids for the processing of metals, especially metals exposed to corrosion. Aqueous mineral oil emulsions or, recently to a greater extent, oil-free cooling lubricants are frequently used in cutting processes for the working of metals, such as, for example, boring, lathing, milling, broaching and many others, and also in the shaping of metals without cutting. These oil-free cooling lubricants are essentially combinations of salts of organic acids, for example of p-tert.-butylbenzoic acid, or of isononanoic acid and water-soluble polyadducts obtained from ethylene oxide and from propylene oxide and/or butylene oxide with compounds containing active hydrogen atoms.

When aqueous mineral oil solutions are used as cooling liquids in metal working, there is the known disadvantage of a tendency towards degreasing, especially because of the influence of heat, because of the change in the pH range or because of a change in electrolytic charge. As a result, a change in the composition and in the activity of the emulsion is caused, which means that, after a certain time, the circulating emulsion is no longer capable of performing the required corrosion inhibiting activity or the necessary lubricating activity. Another disadvantage of mineral oil emulsions is that their milky appearance makes it difficult to observe the progress of the working. The oil-free aqueous cooling lubricants at present used do not have all of these disadvantages of the mineral oil emulsions.

Nevertheless, the corrosion inhibitors, that is to say the abovementioned salts of organic acids, used for these aqueous oil-free cooling lubricants still have the considerable disadvantage that they offer inadequate resistance to hard water and insufficient protection against corrosion.

The corrosion-inhibiting action is also inadequate if the abovementioned salts of organic acids are separated out by precipitation, in particular as a result of the effect of the ions contributing to the hardness of the water, which means an adverse shift of the mixture of corrosion agents and lubricants in the cooling lubricant solutions takes place. Consequently, substantial corrosion both of the tool and of the workpiece can be caused during the working operation.

Novel compounds which are particularly suitable as corrosion inhibitors for aqueous liquids, for example for the cleaning of metals, and especially as corrosion inhibitors for the preparation of oil-free aqueous liquids used for the working of metals, have now been found.

The corrosion inhibitors according to the invention correspond to the following formula (I)

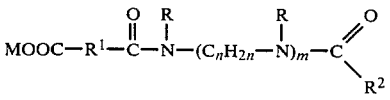

(I)

wherein

R denotes hydrogen or hydroxymethyl, $R^1$ denotes a group corresponding to one of the following formulae

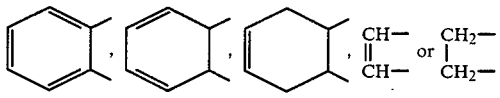

$R^2$ denotes hydrogen, $C_1$–$C_{12}$-alkyl, $C_1$–$C_5$-hydroxyalkyl, phenyl, tert.-butylphenyl or styryl, n denotes 2 or 3, m denotes a number between 1 and 4 and M denotes mono-, di- or tri-ethanolammonium or iso-propanolammonium.

Preferred compounds of the above formula (I) are those in which $R^1$ denotes a group of the formulae

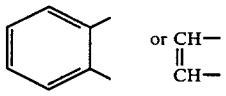

and $R^2$ denotes styryl.

These compounds of the formula (I) are obtained by reacting 1 mole of a polyamine of the formula

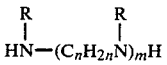

(II)

with one mole of an acid of the formula (III)

with one mole of an anhydride of the formula

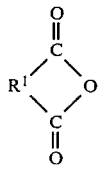

(IV)

and, if appropriate, methylolating the reaction product with formaldehyde and neutralizing the compound of the formula (I) obtained in the form of the free acid with mono-, di- or tri-ethanolamine or with isopropanolamine. Specifically, a procedure is followed in which the polyamine and the acid are heated to a temperature of about 120°–160° C. in a molar ratio of 1:1. The reaction mixture is kept at this temperature until the reaction has ended, and the corresponding water of reaction is thereby distilled off. An inert organic solvent may be present, but this is not absolutely necessary, since the reaction is preferably carried out in the melt, without a solvent. The anhydride is then added slowly at the same temperature and the mixture is allowed to after-react for about two hours. Instead of the anhydride, the corresponding free acids can also successfully be used in many cases.

If a compound of the formula (I) in which R denotes hydroxymethyl is to be obtained, the reaction product can be reacted with formaldehyde or formaldehyde-donating compounds by known methods before the neutralization. This methylolation can be carried out to completion or to only partial completion, a mixture of compounds in which R is H or hydroxymethyl being obtained in the latter case.

When the reaction has ended and before the mixture has cooled, at least 3 moles of water, per mole of polyamine, are also added, and the mixture is allowed to cool. The compound of the formula (I) is obtained in the form of the free acid and is then, for use, brought to a pH value of 8 to 10, preferably 9, by addition of mono-, di- or tri-ethanolamine or isopropanolamine.

EXAMPLE 1

A mixture of 103 g (1 mole) of diethylenetriamine and 148 g (1 mole) of cinnamic acid is heated to a temperature of 145° C., during which 17 ml of water are distilled off. The temperature is then allowed to fall to 120° C. and 145 g (1 mole) of phthalic anhydride are added in small amounts in the course of 2 hours such that the temperature of 120° C. is maintained.

60 g (1 mole) of monoethanolamine and 150 g of water are then added. The product thus obtained is a red liquid which is water-miscible and exhibits very good cooling lubricant properties.

EXAMPLE 2

179 g (1 mole) of tert.-butylbenzoic acid and 103 g (1 mole) of diethylenetriamine are reacted as described in Example 1. 148 g (1 mole) of phthalic anhydride is then slowly added at 120° C. until everything has dissolved. A further 61 g (1 mole) of monoethanolamine and 180 g of water are then added and the mixture is allowed to cool. A product with the same properties as in Example 1 is obtained.

EXAMPLE 3

158 g (1 mole) of isononanoic acid and 103 g (1 mole) of diethylenetriamine are reacted as described in Example 1. 148 g (1 mole) of phthalic anhydride are slowly added at 120° C. until everything has dissolved. A further 105 g (1 mole) of diethanolamine and 180 g of water are then added and the mixture is allowed to cool. A product with the same properties as in Example 1 is obtained.

USE EXAMPLES

The novel compounds of the formula (I) are preferably used as corrosion inhibitors in aqueous oil-free liquids, and in the preparation of aqueous oil-free liquids for the working of metals. The aqueous oil-free liquids mentioned are chiefly used for processes for the working of metals without cutting and with cutting, in particular for the working of iron or iron-containing metals. All the disadvantages of the mineral oil emulsions and also of the abovementioned oil-free cooling lubricants are avoided by using the compounds according to the invention. A substantial advantage of the oil-free cooling lubricants which are prepared using the novel compounds of the formula (I) according to the invention is the more powerful anti-corrosion action of these novel products in comparison with the lubricants of the prior art. The aqueous oil-free cooling lubricants prepared with addition of the novel products of the formula (I) according to the invention can be used over a very wide field of application. The lubricants according to the invention are highly stable and highly active during use. The compounds of the formula (I) according to the invention have such a high anti-corrosion action that addition of between 0.5% and 5.0% by weight is sufficient to impart the required anti-corrosion action to oil-free cooling lubricants, even where the metal surfaces are particularly exposed to corrosion. The compounds of the formula (I) according to the invention are preferably used in amounts of between 1% and 2% by weight in aqueous oil-free cooling lubricants.

The advantages of the novel products in comparison with known water-soluble corrosion inhibitors, such as alkanolamine salts of isononanoic acid or of p-tert.-butylbenzoic acid can be seen from the investigation results summarized in the table which follows. In these investigations, the solubility, foaming properties and anti-corrosion properties of the products listed were compared with one another. The appearance of a 3% strength aqueous solution after standing for 24 hours was used to determine the solubility. The foaming properties were tested in accordance with DIN 53,902 and the corrosion was tested by comparison, taking into consideration the following molar proportions:

(A)

22% by weight of isononanoic acid
63% by weight of triethanolamine
15% by weight of $H_2O$ (B)

25% by weight of p-tert.-butylbenzoic acid
60% by weight of triethanolamine
15% by weight of $H_2O$ (C)

40% by weight of the product according to Example 1
45% by weight of triethanolamine
15% by weight of $H_2O$ (D)

35% by weight of the product according to Example 2
50% by weight of triethanolamine
15% by weight of $H_2O$ (E)

35% by weight of the product according to Example 3
50% by weight of triethanolamine
15% by weight of $H_2O$

TABLE

| | A | B | C | D | E |
|---|---|---|---|---|---|
| Solubility | | | | | |
| 3% strength aqueous solution in distilled $H_2O$ | | | | | |
| (a) after preparation | clear | clear | clear | clear | clear |
| (b) after 24 hours | clear | clear | clear | clear | clear |
| In tap water/German hardness of 20° | | | | | |
| (a) after preparation | clear | clear | clear | clear | clear |
| (b) after 24 hours | cloudy | crystalline | clear | clear | clear |

TABLE-continued

| | A | B | C | D | E |
|---|---|---|---|---|---|
| | sediment | sediment | | | |
| Foaming properties | | | | | |
| DIN 53 902 | foam collapses slowly | foam collapses slowly | no foam | no foam | no foam |
| Corrosion protection | | | | | |
| DIN 51 360/I | | | | | |
| 1% strength solution in German hardness of 20° (tap water) | trace of rust | no rust | trace of rust | no rust | trace of rust |
| 2% strength solution in German hardness of 20° (tap water) | no rust | no rust | no rust | no rust | no rust |
| DIN 51 360/2 | | | | | |
| 2% strength solution in German hardness of 20° (synthesis water) | significant rust | significant rust | significant rust | no rust | no rust |
| 3% strength solution in German hardness of 20° (synthesis in water) | no rust | no rust | no rust | no rust | no rust |

We claim:

1. A compound of the general formula

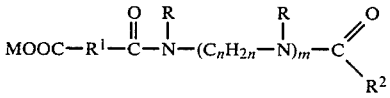

(I)

in which

R denotes hydrogen or hydroxymethyl, $R^1$ denotes a group of the formulae

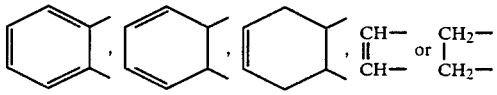

$R^2$ denotes hydrogen, $C_1$–$C_{12}$-alkyl, $C_1$–$C_5$-hydroxyalkyl, phenyl, tert.-butylphenyl or styryl, n denotes 2 or 3, m denotes a number from 1 to 4 and M denotes mono-, di- or tri-ethanolammonium or iso-propanolammonium.

2. A compound as claimed in claim 1, in which $R^1$ denotes a group of the formulae

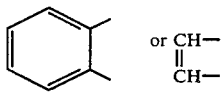

and $R^2$ denotes styryl.

3. A process for the preparation of a compound as claimed in claim 1, which comprises reacting one mole of a polyamine of the formula

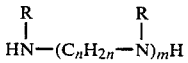

(II)

with one mole of an acid of the formula $R^2$—COOH and one mole of an anhydride of the formula

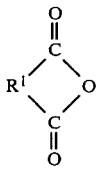

(III)

methylolating the reaction product with formaldehyde if R represents hydroxymethyl and neutralizing the compound of the formula (I) obtained in the form of the free acid with mono-, di- or tri-ethanolamine or with iso-propanolamine.

4. A corrosion-inhibiting aqueous liquid containing therein between about 0.5% or 5.0% by weight of a compound of claim 1.

5. A cooling lubricant containing therein between about 0.5% and 5.0% weight of a compound of claim 1.

* * * * *